US007740146B2

(12) United States Patent
Cavalcante et al.

(10) Patent No.: US 7,740,146 B2
(45) Date of Patent: Jun. 22, 2010

(54) CONTAINER

(75) Inventors: Mauricio D. Cavalcante, Atlanta, GA (US); Gerald R. Koefelda, Sunningdale (GB)

(73) Assignee: Rehrig Pacific Company, Los Angeles, CA (US)

( * ) Notice: Subject to any disclaimer, the term of this patent is extended or adjusted under 35 U.S.C. 154(b) by 223 days.

(21) Appl. No.: 12/138,489

(22) Filed: Jun. 13, 2008

(65) Prior Publication Data

US 2008/0308552 A1 Dec. 18, 2008

Related U.S. Application Data

(60) Provisional application No. 60/943,839, filed on Jun. 13, 2007.

(51) Int. Cl.
*B65D 6/00* (2006.01)
*B65D 8/14* (2006.01)

(52) U.S. Cl. ..... 220/6; 220/4.28

(58) Field of Classification Search ..... 220/4.28, 220/6, 7, 653; 206/506; 211/195, 206
See application file for complete search history.

(56) References Cited

U.S. PATENT DOCUMENTS

| | | | | |
|---|---|---|---|---|
| 7,357,269 | B2 * | 4/2008 | Apps | 220/6 |
| 2007/0095842 | A1 | 5/2007 | Apps | |
| 2007/0125779 | A1 * | 6/2007 | Cope | 220/6 |

FOREIGN PATENT DOCUMENTS

| | | |
|---|---|---|
| EP | 1 785 360 | 5/2007 |

OTHER PUBLICATIONS

Decision on Appeal for U.S. Appl. No. 11/264,371, mailed on May 11, 2009.
European Search Report for EP Application No. 08275027.4, Sep. 8, 2008.

* cited by examiner

*Primary Examiner*—Anthony Stashick
*Assistant Examiner*—Harry A Grosso
(74) *Attorney, Agent, or Firm*—Carlson, Gaskey & Olds

(57) ABSTRACT

A collapsible container includes a plurality of walls collapsible onto the base. A first wall has a support pivotable between a support position where it is partially supported on an adjacent wall and a retracted position. An adjacent wall has a stop formed thereon which forces the support into the support position when the first wall is moved to the upright position.

11 Claims, 9 Drawing Sheets

CONTAINER

This application claims priority to U.S. Provisional Application Ser. No. 60/943/839, filed Jun. 13, 2007.

BACKGROUND OF THE INVENTION

The present invention relates generally to collapsible crates and more particularly to a collapsible crate with support members for supporting another container thereon.

Collapsible crates are well known. Four walls each connected via a hinge to a base are selectively movable about the hinge between a use position, in which the wall is generally perpendicular to the base, and a collapsed position onto the base. Various mechanisms have been provided to connect adjacent walls at the corner to selectively lock the crate in the use position.

Some collapsible crates also include retractable supports so that another container can be supported thereon. One such crate includes end walls each having a support that is partially supported on the adjacent walls when in the support position. As the end walls are pivoted to the upright position, a biasing member on the support contacts a portion of the adjacent wall to automatically move the support to the support position. However, the biasing members are subject to breakage.

SUMMARY OF THE INVENTION

The present invention provides a collapsible container having a plurality of walls collapsible onto the base. At least one wall has a support movable between a support position where it is partially supported on an adjacent wall and a retracted position. In the retracted position, the wall can lie flat on the base.

In one embodiment, when the wall is pivoted to the upright position, a hard stop on the adjacent wall moves the support to the support position. Thus, the supports are always guaranteed to be fully in the support position, so that a container stacked thereon will not fall into the lower container and damage the goods in the lower container.

In another embodiment, the hard stop moves the support only partly from the retracted position toward the support position. This makes it easier for the user to move the support fully to the support position. The support in the partly retracted position permits some additional access to the mouth of the container.

The supports may be formed on short end walls of the container, such that the supports and end walls can be collapsed onto the base and the long side walls can be pivoted onto the end walls.

BRIEF DESCRIPTION OF THE DRAWINGS

Other advantages of the present invention can be understood by reference to the following detailed description when considered in connection with the accompanying drawings wherein.

DETAILED DESCRIPTION OF THE PREFERRED EMBODIMENTS

Figure 1:
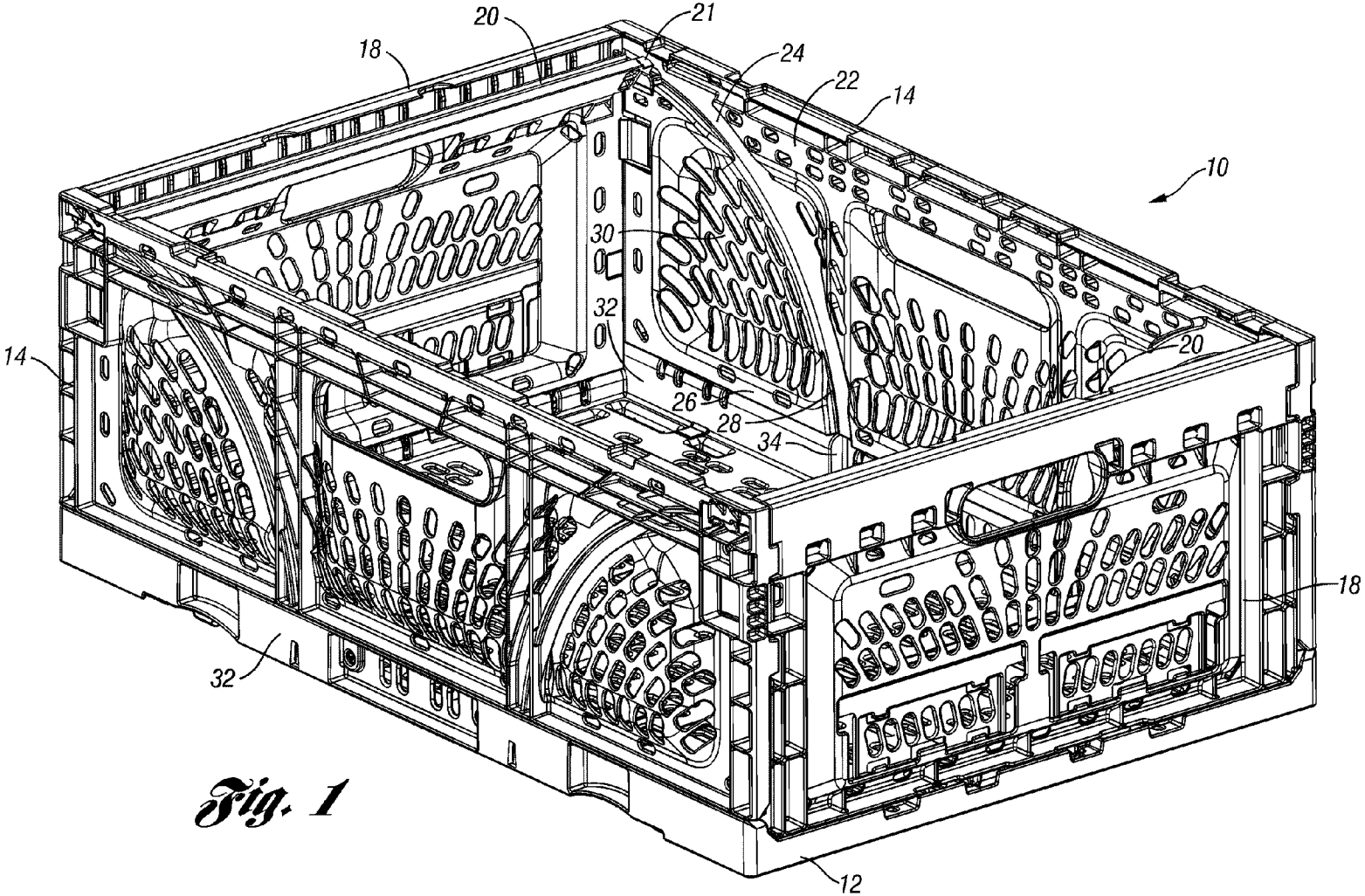
FIG. 1 is a perspective view of a container according to the present invention in the assembled position.
Figure 2:
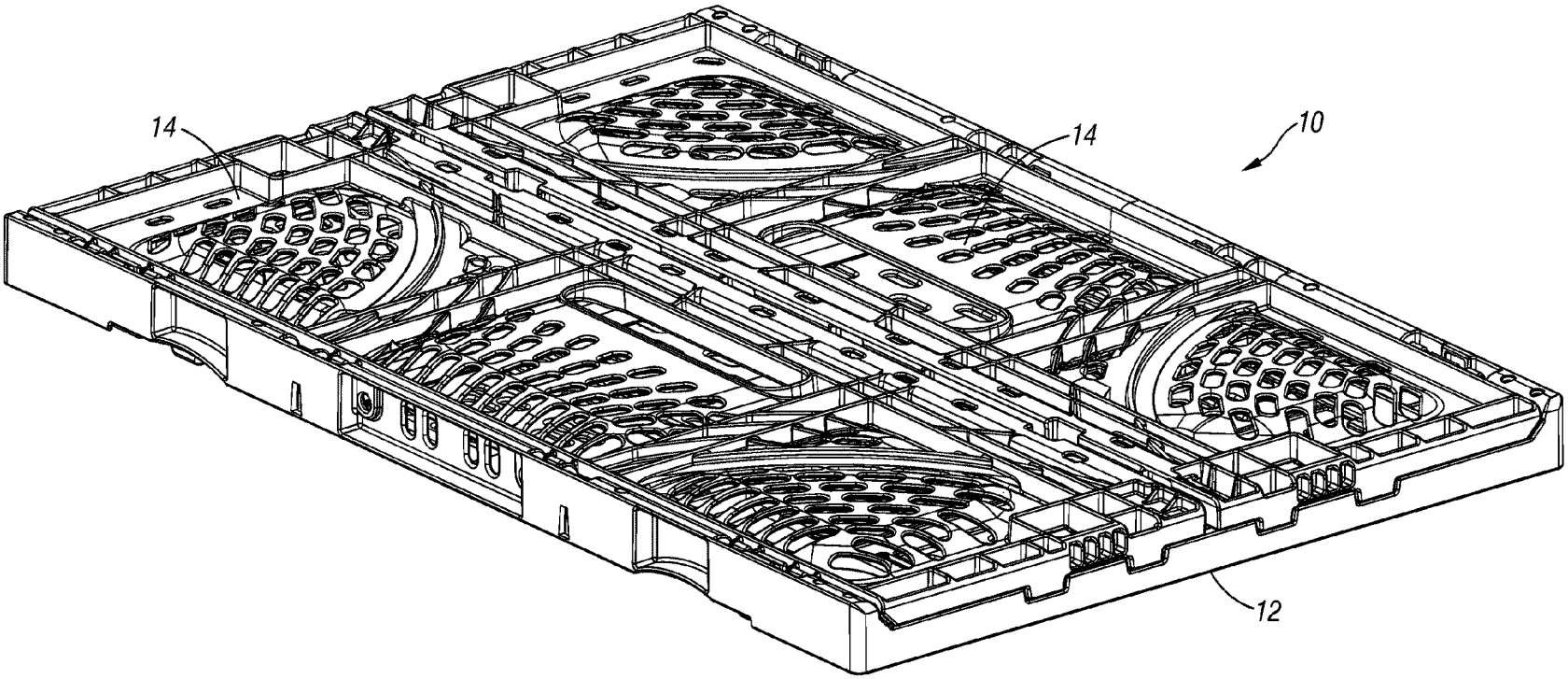
FIG. 2 is a perspective view of the container of FIG. 1 in a collapsed position.

Referring to FIG. 1, a container 10 includes a base 12 having upstanding side walls 14 (or long walls) and upstanding end walls 18 (or short walls). The side walls 14 and end walls 18 are pivotably connected along long and short edges of the base 12, respectively. The side walls 14 and end walls 18 are movable between the upright position shown in FIG. 1 and a collapsed position on the base 12, as shown in FIG. 2.

Figure 3:
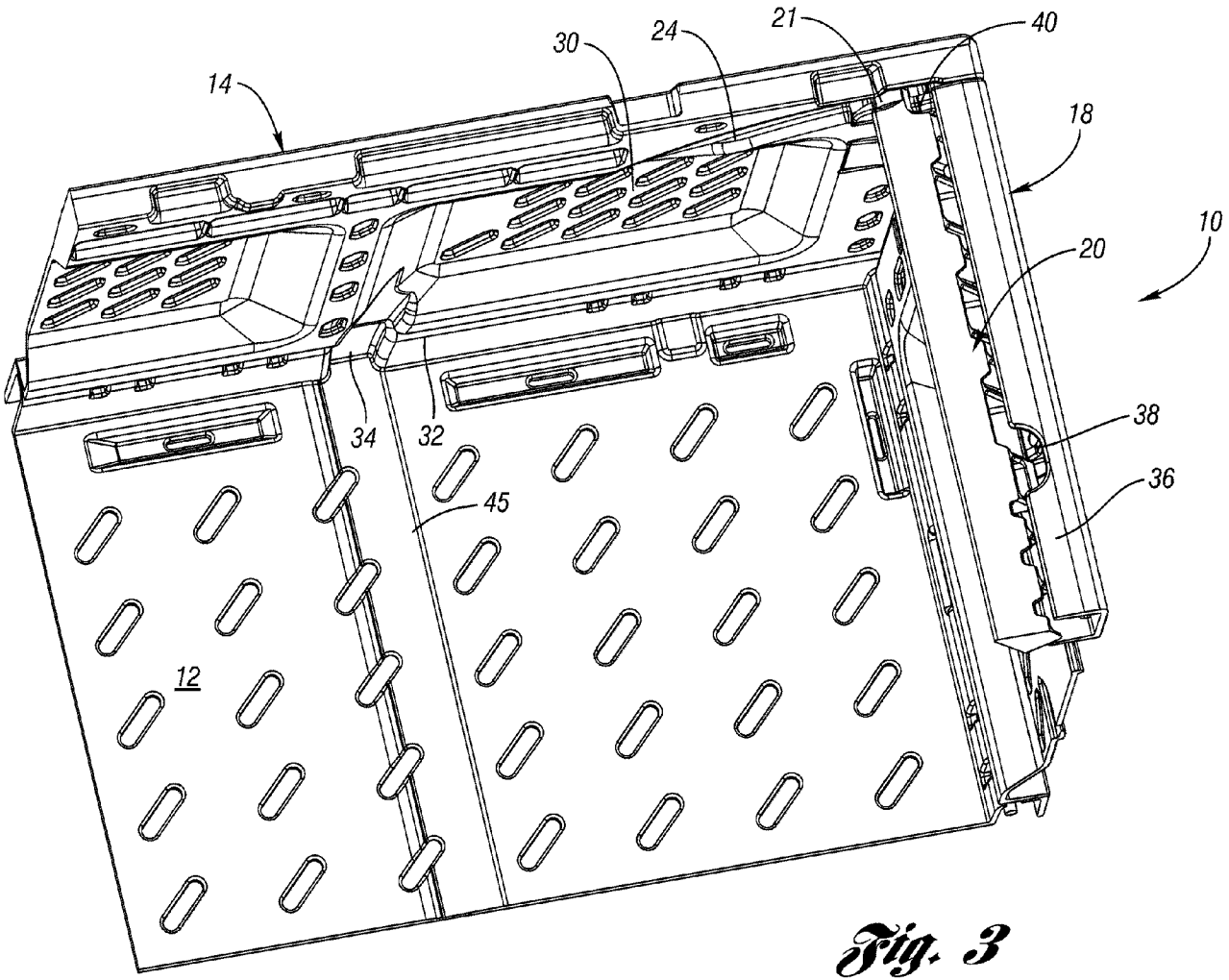
FIG. 3 is a perspective view of a quarter of the container of FIG. 1. The other quadrants would be mirror images.

Referring to FIG. 3, each end wall 18 has a support 20 (or flap). The support 20 is pivotably mounted at its lower edge to a position spaced below an upper edge of the end wall 18. The support 20 is shown in FIG. 3 in a support position where it projects into the interior of the container 10, partly narrowing the mouth of the container 10. The support 20 includes a tab 21 projecting from each side into the side wall 14. The end wall 18 includes a lip 36 protruding inwardly from the uppermost edge above the support 20. The lip 36 includes at least one inwardly-open cutout 38 therethrough.

The interiors of the side walls 14 each include an upper frame portion 22 protruding into the container 10. A curved channel 24 is formed through each upper frame portion 22. The interior of the side walls 14 each further include a lower frame portion 26 having a pair of channels 28 formed therethrough. A recess 30 is defined between the upper frame portion 22 and the lower frame portion 26. The base 12 includes a pair of side upstanding portions 32 to which the side walls 14 are pivotably attached. Each side upstanding portion 32 includes a pair of channels 34 formed on an interior thereof. The channels 24, 28 and 34 are aligned with one another and with the tabs 21 on the supports 20, so that the end walls 18 can be pivoted to the collapsed position.

Figure 5:
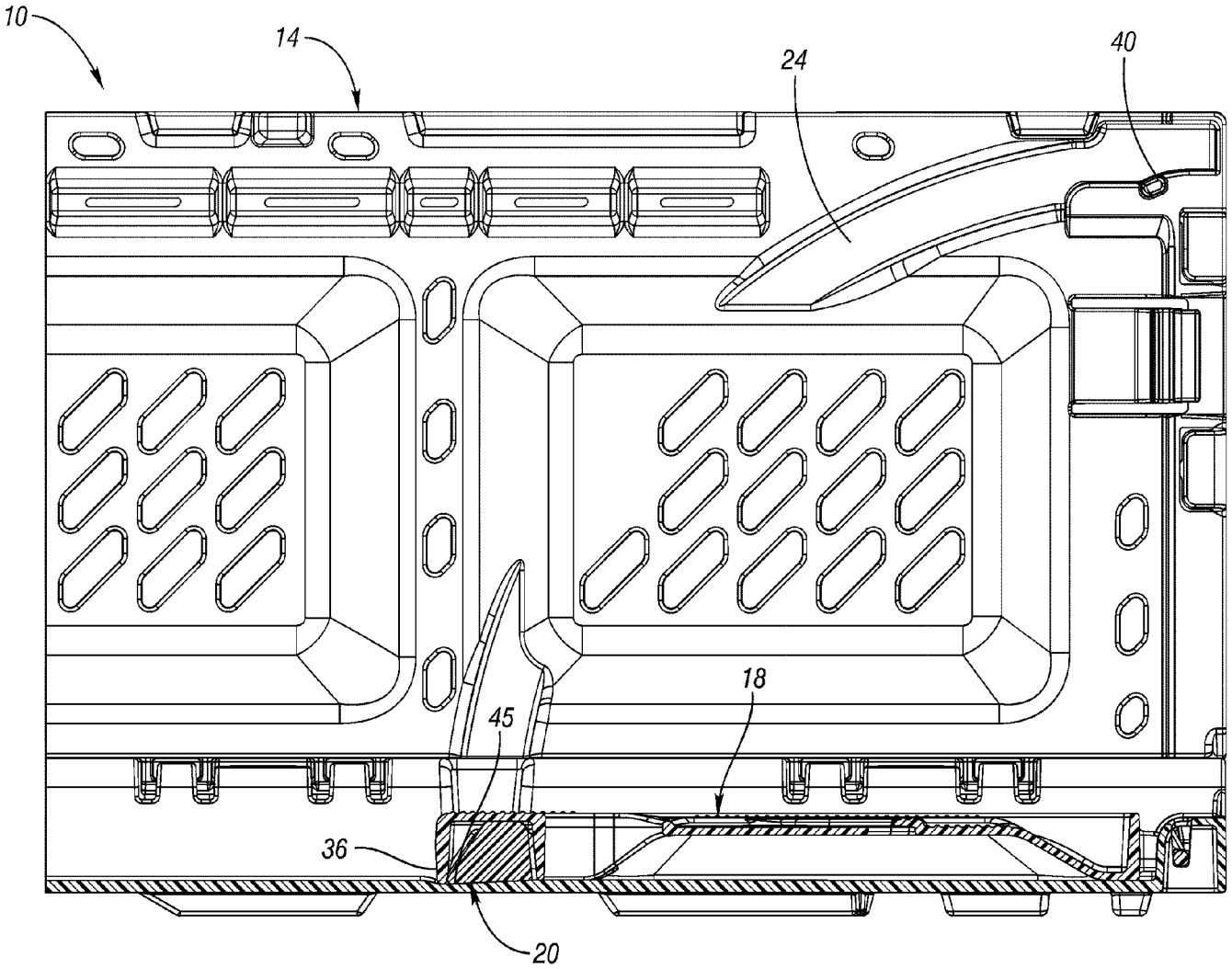
FIG. 5 is partial section view of the container of FIG. 1 with the end wall in the collapsed position.

Referring to FIG. 3, the base 12 includes a pair of shallow recessed channels 45 (one shown) in alignment with the channels 34 of the side upstanding portions 32. When the end wall 18 is collapsed onto the base 12 as shown in FIG. 5, the lip 36 of the end wall 18 and the upper edge of the support 20 are received in the channel 45 in the base 12. The lip 36 and the support 20 both project toward the interior of the container 10 further than the inner surface of the remainder of the end wall 18, so the recess 45 permits the end wall 18 to lie flatter on the base 12. This reduces the overall stacking height of the container 10 in a collapsed position.

Figure 4:
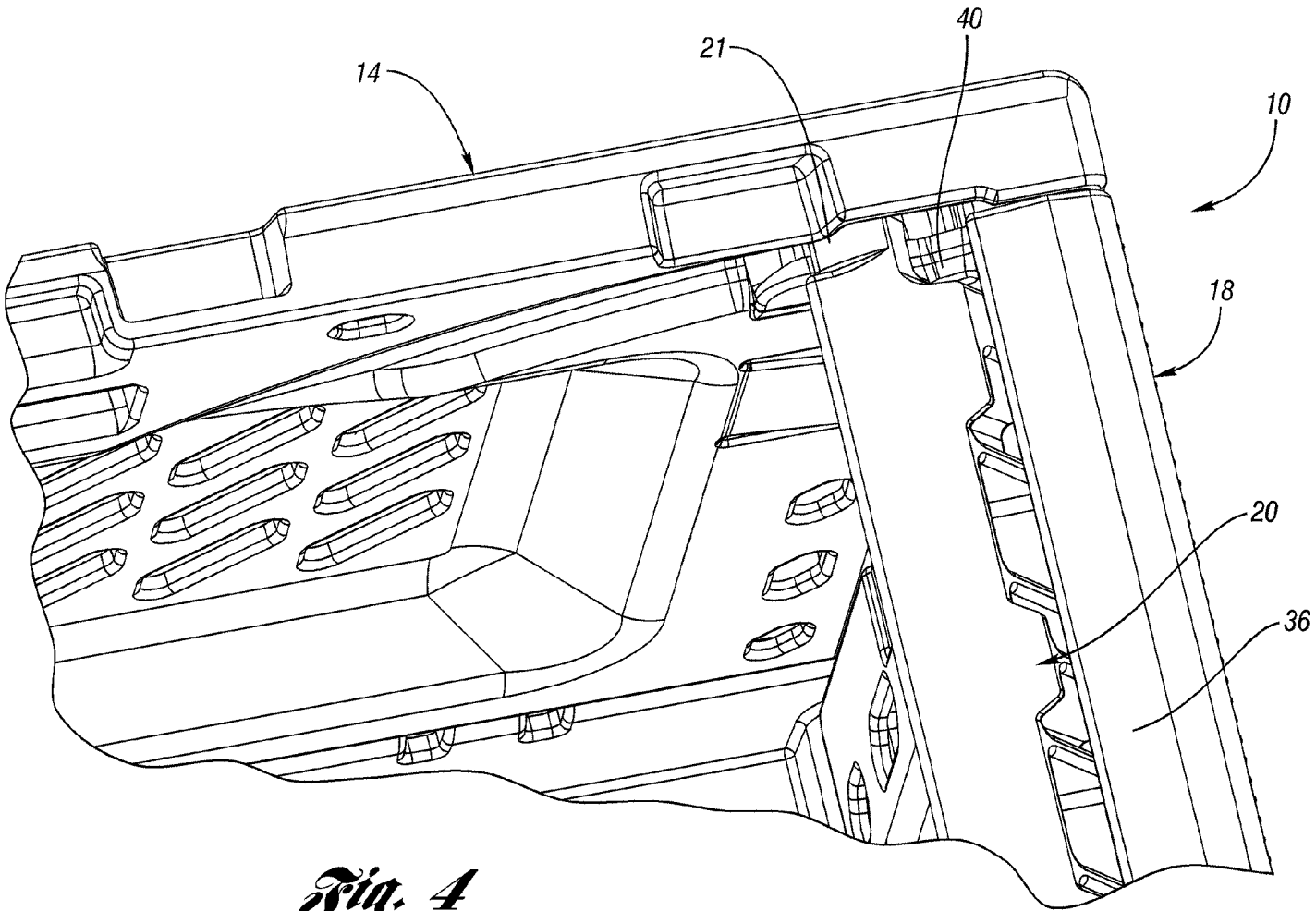
FIG. 4 is an enlarged view of the corner of the container of FIG. 3.
Figure 6:
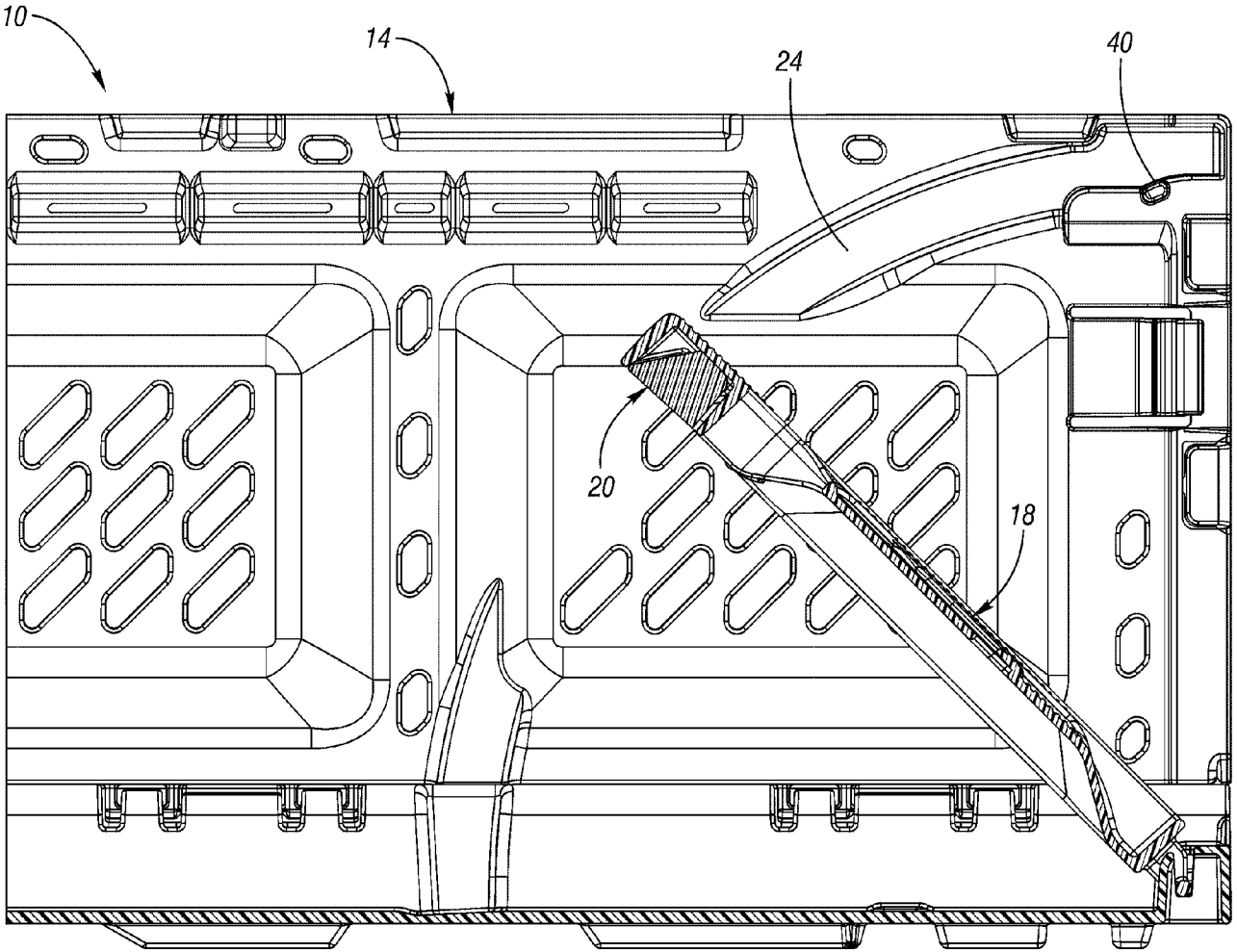
FIG. 6 is a view similar to that of FIG. 5, with the end wall being pivoted toward the upright position.

Referring to FIG. 4, each side wall 14 includes a stop 40 projecting inward adjacent the channel 24. As the end wall 18 is pivoted toward the upright position, the tab 21 (FIG. 3) of the support 20 passes through the channel 24 in the side wall 14. In FIG. 6, the end wall 18 is being pivoted toward the upright position from the position of FIG. 5. The tab 21 passes through the channels 24, 28, 34 and the recess 30 in side wall 14 as the end wall 18 is pivoted toward the upright position, as shown in FIG. 6.

Figure 7:
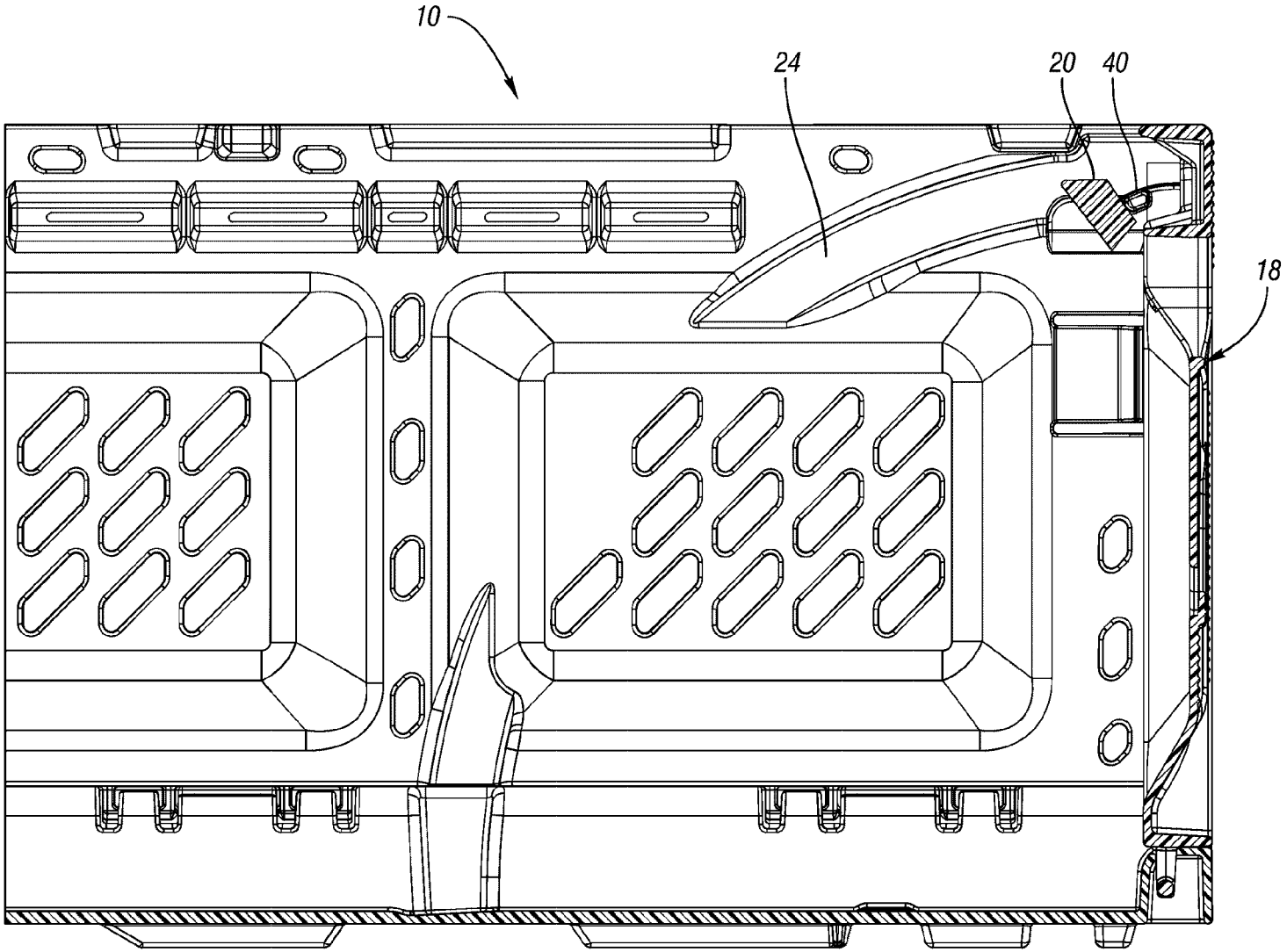
FIG. 7 is a view similar to that of FIG. 5 with the end wall in the upright position and the support in the deployed position.

As shown in FIG. 7, the support then contacts the stops 40 (one shown—the other one is on the opposite side wall 14) and is forced from the retracted position below lip 36 to the support position as shown. Thus, in this embodiment, the support 20 cannot be moved to the retracted position when the end wall 18 and the side wall 14 are in the upright position. This guarantees that the supports 20 will be ready to support a container thereon. Further, there is no need for a user to manually deploy the supports 20 after erecting the walls 14, 18.

As another feature of the present invention, the side wall 14 is designed such that the stop 40 can easily be removed from the mold (such as by adding an insert). As can be seen in FIG. 7, the channel 24 continues past the stop 40, such that without the stop 40, the support 20 could be retracted completely into the end wall 18. Thus, containers with or without the automatic deployment of the supports 20 could be made in the same molds.

Figure 8:
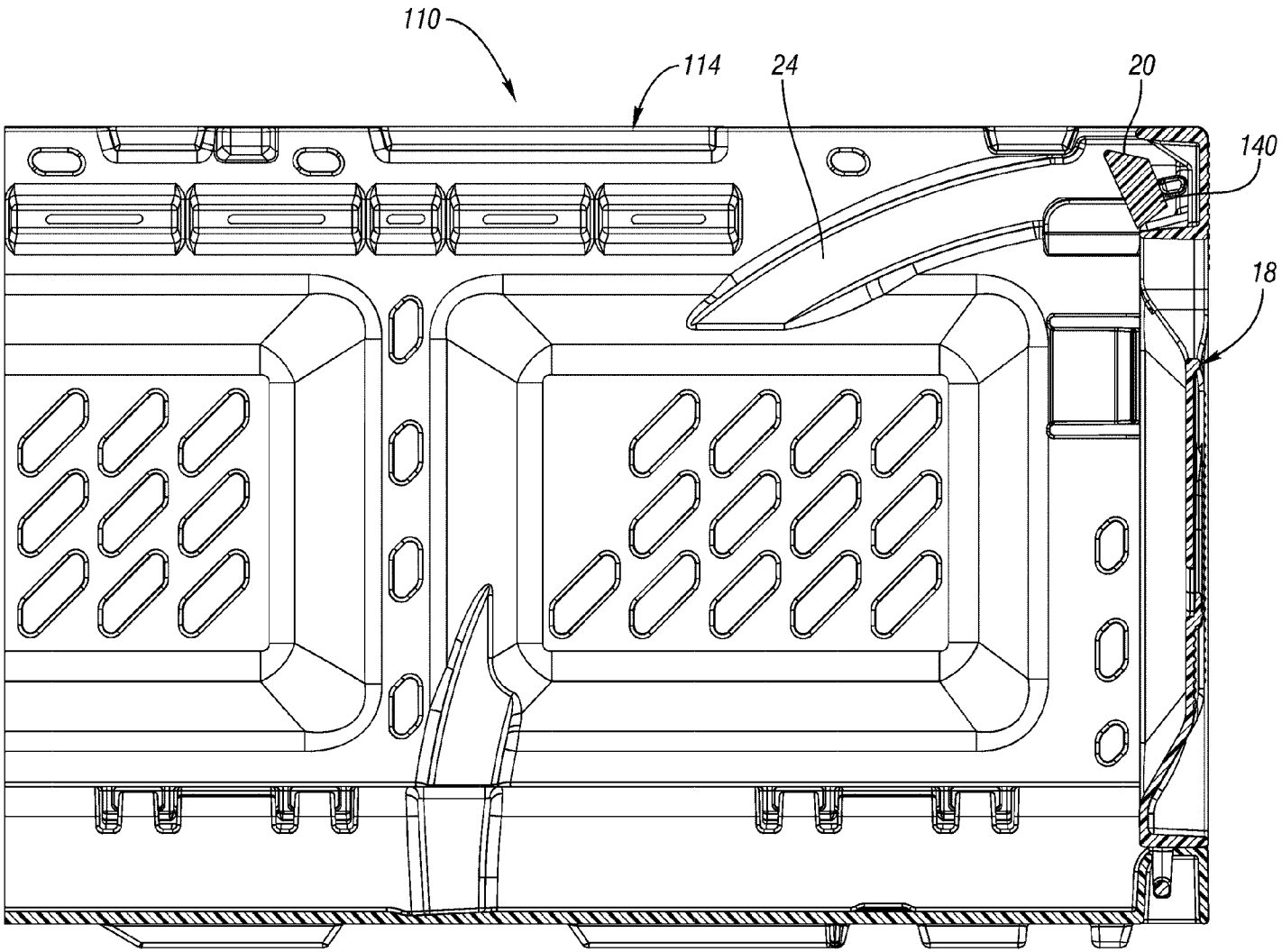
FIG. 8 is a view similar to that of FIG. 7 of a container according to a second embodiment of the present invention.

A container 110 according to another embodiment is shown in FIG. 8. The container 110 is identical to the container 10 of FIGS. 1-7 except as shown in FIG. 8 or described below. The container 110 has a stop 140 that is closer to the end wall 18 than the stop 40, such that the support 20 is only partially deployed by the stop 140 as the end wall 18 is moved to the upright position. FIG. 8 illustrates the support 20 moved to the partially deployed position by the stop 140. This makes it easier for the user to move the support 20 to the fully deployed position, similar to that as shown in FIG. 7. Gravity may then permit the support 20 to fall the rest of the way into the support position, but also permit the support 20 to be moved toward the end wall 18 to the extent shown for greater access through the opening of the container 110. Alternatively, the container 110 can be used with the support in the partially deployed position (without supporting another container thereon), in which case, the supports 20 restrict the mouth of the container 110 less than the supports 20 of the container 10 of FIGS. 1-7.

Figure 9:
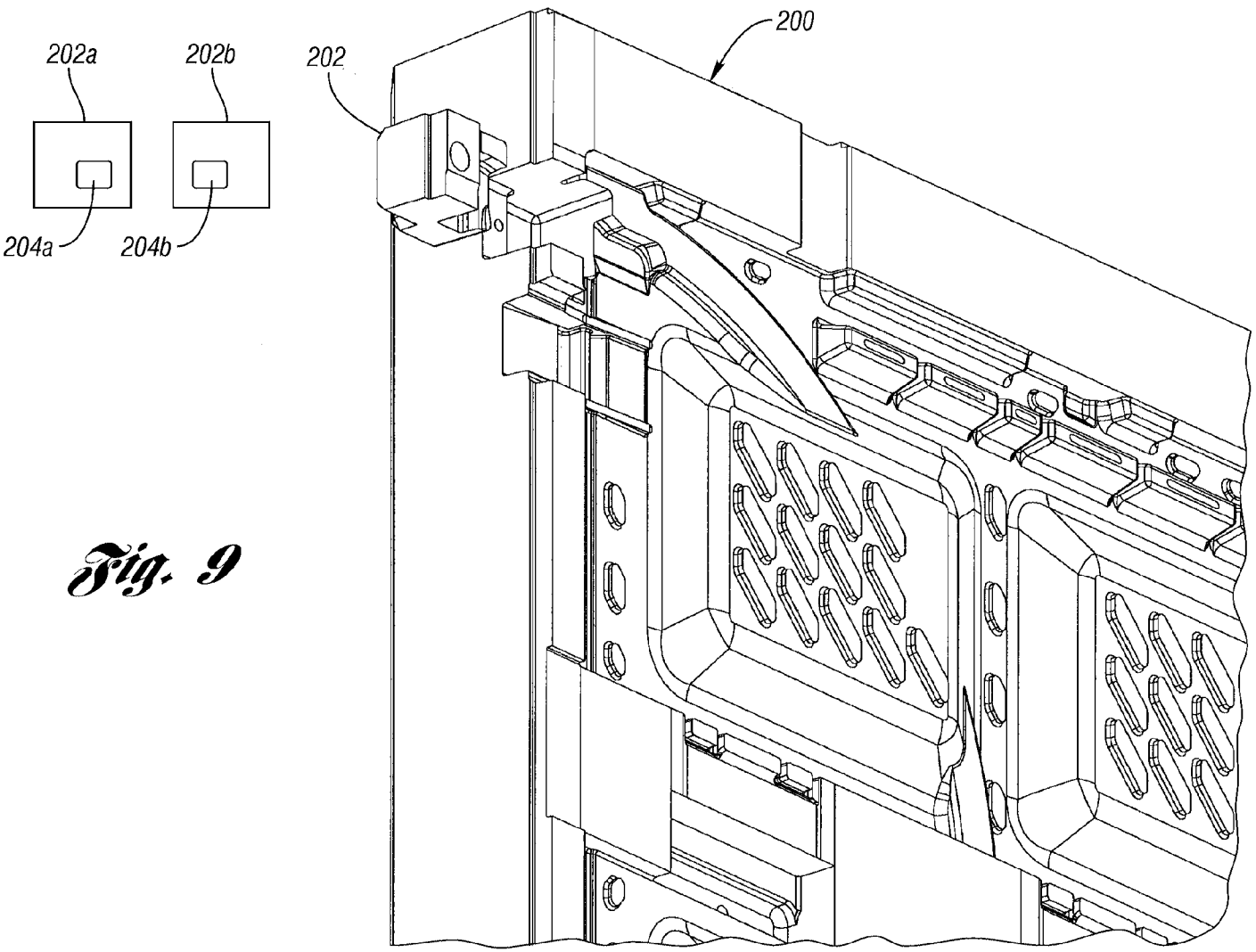
FIG. 9 illustrates a mold half for making the side wall of FIGS. 1-7 or FIG. 8 or a side wall without a stop.

FIG. 9 illustrates a mold half 200 for making the side wall 14 of FIGS. 1-7 or a side wall 114 according to FIG. 8 or a side wall without a stop 40, 140. A side wall without a stop can be made by using the insert 202 in the mold half 200. A side wall 14 with a full hard stop 40 according to FIGS. 1-7 can be made with the insert 202*a* in the mold half 200, the insert 202*a* having a recess 204*a* corresponding to the hard stop 40. A side wall 114 with a partial hard stop 140 according to FIG. 8 can be made with the insert 202*b* in the mold half 200, the insert 202*b* having a recess 204*b* corresponding to the hard stop 140. Thus, the same mold half 200 can be used to make any of the desired types of side walls 114.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A container comprising:

a base;

a first wall pivotably mounted to the base and pivotable between an upright position and a collapsed position;

a second wall pivotably mounted to the base and pivotable between an upright position and a collapsed position, the second wall including a stop protruding inwardly of the container; and a support pivotably mounted to the first wall, the support pivotable between a support position and a retracted position, the support contacting the stop of the second wall as the first wall is moved toward the upright position to force the support toward the support position.

2. The container of claim 1 wherein the support has a lower end pivotably attached to the first wall below an uppermost edge of the first wall.

3. The container of claim 1 wherein the support includes a laterally-extending tab, the tab contacting the second wall to support the support in the support position.

4. The container of claim 3 wherein the second wall includes a channel on an interior surface thereof, the tab passing through the channel as the first wall and the support are pivoted relative to the base to a collapsed position on the base.

5. The container of claim 4 wherein the stop is formed in the channel of the second wall, such that the channel continues past the stop.

6. The container of claim 1 wherein support is moved completely into the support position by the stop of the second wall when the first wall is moved to the upright position.

7. The container of claim 1 wherein support is moved partially toward the support position by the stop of the second wall when the first wall is moved to the upright position.

8. A container comprising:

a base;

a first wall pivotable between an upright position and a collapsed position;

a second wall pivotable between an upright position and a collapsed position, the second wall having a channel formed on an interior surface, and a hard stop formed in the channel and projecting inwardly into the container; and a support mounted to the first wall, the support movable relative to the first wall between a support position and a retracted position, the support contacting the hard stop as the first wall is moved to the upright position, which forces the support toward the support position.

9. The container of claim 8 wherein the channel continues past the stop.

10. The container of claim 8 wherein support is moved completely into the support position by the stop of the second wall when the first wall is moved to the upright position.

11. The container of claim 8 wherein support is moved partially toward the support position by the stop of the second wall when the first wall is moved to the upright position.

* * * * *